US006758636B2

(12) United States Patent
Rainey et al.

(10) Patent No.: US 6,758,636 B2
(45) **Date of Patent: *Jul. 6, 2004**

(54) SEGMENTAL RETAINING WALL SYSTEM

(75) Inventors: Thomas L. Rainey, Acworth, GA (US); Svenn Borgersen, Eagan, MN (US); John W. Turgeon-Schramm, Brooklyn Park, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/036,037

(22) Filed: Dec. 28, 2001

(65) Prior Publication Data

US 2002/0172563 A1 Nov. 21, 2002

Related U.S. Application Data

(63) Continuation-in-part of application No. 09/049,627, filed on Mar. 27, 1998, now Pat. No. 6,338,597.

(51) Int. Cl.[7] ..... E02D 17/00; E04C 1/00

(52) U.S. Cl. ..... 405/262; 405/286; 52/286; 52/603; 52/605; 52/607

(58) Field of Search ..... 405/262, 284, 405/286; 52/603–605, 607, 283, 284, 286

(56) References Cited

U.S. PATENT DOCUMENTS

| | | | | | |
|---|---|---|---|---|---|
| 748,603 | A | * | 1/1904 | Henry | 52/590.1 |
| 1,130,324 | A | | 3/1915 | Owen | 446/127 |
| 1,162,409 | A | * | 11/1915 | Shimer | 52/590.1 |
| 4,448,571 | A | * | 5/1984 | Eckels | 405/284 |
| 4,470,728 | A | * | 9/1984 | Broadbent | 405/284 |
| 4,490,075 | A | * | 12/1984 | Risi et al. | 405/273 |
| 4,530,622 | A | * | 7/1985 | Mercer | 405/284 |
| 4,601,148 | A | * | 7/1986 | Risi et al. | 52/284 |
| 4,815,897 | A | * | 3/1989 | Risi et al. | 405/284 |
| 4,824,293 | A | * | 4/1989 | Brown et al. | 405/284 |
| 4,914,876 | A | * | 4/1990 | Forsberg | 405/286 |
| 4,968,186 | A | * | 11/1990 | Ogorchock | 405/262 |
| 5,044,834 | A | * | 9/1991 | Janopaul, Jr. | 405/284 |
| 5,064,313 | A | * | 11/1991 | Risi et al. | 405/284 |
| 5,066,169 | A | * | 11/1991 | Gavin et al. | 405/284 |
| 5,114,270 | A | * | 5/1992 | Riddle | 405/15 |
| 5,248,226 | A | * | 9/1993 | Risi et al. | 405/284 |
| 5,257,880 | A | * | 11/1993 | Janopaul, Jr. | 405/284 |
| 5,282,700 | A | * | 2/1994 | Rodrique | 405/284 |
| 5,294,216 | A | * | 3/1994 | Sievert | 405/286 |
| D350,611 | S | * | 9/1994 | Scales | D25/114 |
| 5,417,523 | A | * | 5/1995 | Scales | 405/284 |
| 5,511,910 | A | * | 4/1996 | Scales | 405/262 |
| 5,522,682 | A | * | 6/1996 | Egan | 405/262 |
| 5,540,525 | A | * | 7/1996 | Miller et al. | 405/284 |
| 5,568,998 | A | * | 10/1996 | Egan et al. | 405/262 |
| 5,568,999 | A | * | 10/1996 | Egan et al. | 405/262 |
| 5,580,191 | A | * | 12/1996 | Egan | 405/262 |
| 5,595,460 | A | * | 1/1997 | Miller et al. | 405/284 |
| 5,607,262 | A | * | 3/1997 | Martin | 405/284 |

(List continued on next page.)

FOREIGN PATENT DOCUMENTS

| | | | |
|---|---|---|---|
| WO | WO-97/44533 | * | 11/1997 |

*Primary Examiner*—Robert E. Pezzuto
*Assistant Examiner*—Tara L. Mayo
(74) *Attorney, Agent, or Firm*—Merchant & Gould P.C.

(57) ABSTRACT

A wall block for use in a segmental retaining wall system. The wall block comprises an interior face for forming an interior surface of a segmental retaining wall, an exterior face for forming an exterior surface of the segmental retaining wall, first and second sides that extend from the exterior face to the interior face, and a top surface and a bottom surface. Further provided in the wall block is a channel defined by a front wall, a rear wall, and an arcuate bottom surface. The channel extends across one of the faces and surfaces.

14 Claims, 10 Drawing Sheets

U.S. PATENT DOCUMENTS 5,619,835 A * 4/1997 Bailey et al. ..... 52/606
5,622,456 A * 4/1997 Risi et al. ..... 405/284
5,647,185 A * 7/1997 Forlini ..... 52/604
5,673,530 A * 10/1997 Bailey, II ..... 52/606
5,697,735 A * 12/1997 Egan ..... 405/262
5,800,097 A * 9/1998 Martin ..... 405/284
5,816,749 A * 10/1998 Bailey, II ..... 405/286
5,899,040 A * 5/1999 Cerrato ..... 52/604
6,224,295 B1 * 5/2001 Price et al. ..... 405/262

* cited by examiner

SEGMENTAL RETAINING WALL SYSTEM

CROSS-REFERENCE TO RELATED APPLICATION

This is a continuation-in-part of U.S. patent application Ser. No. 09/049,627, now U.S. Pat. No. 6,338,597 filed Mar. 27, 1998, which is hereby incorporated by reference in its entirety into the present disclosure.

FIELD OF THE INVENTION

The invention relates generally to earth retaining walls. More particularly, the invention relates to a segmental retaining wall system comprising retaining means for attaching reinforcement members to the retaining wall.

BACKGROUND OF THE INVENTION

Segmental retaining walls commonly comprise courses of modular units (blocks). The blocks are typically made of concrete. The blocks are typically dry-stacked (no mortar or grout is used), and often include one or more features adapted to properly locate adjacent blocks and/or courses with respect to one another, and to provide resistance to shear forces from course to course. The weight of the blocks is typically in the range of ten to one hundred fifty pounds per unit. Segmental retaining walls commonly are used for architectural and site development applications. Such walls are subjected to high loads exerted by the soil behind the walls. These loads are affected by, among other things, the character of the soil, the presence of water, temperature and shrinkage effects, and seismic loads. To handle the loads, segmental retaining wall systems often comprise one or more layers of soil reinforcement material extending from between the courses of blocks back into the soil behind the blocks. The reinforcement material is typically in the form of a geogrid or a geofabric. Geogrids often are configured in a lattice arrangement and are constructed of polymer fibers or processed plastic sheet material (punched and stretched, such as described, for example, in U.S. Pat. No. 4,374,798), while reinforcement fabrics are constructed of woven, nonwoven, or knitted polymer fibers or plastics. These reinforcement members typically extend rearwardly from the wall and into the soil to stabilize the soil against movement and thereby create a more stable soil mass which results in a more structurally secure retaining wall. In other instances, the reinforcement members comprise tie-back rods that are secured to the wall and which similarly extend back into the soil.

Although several different forms of reinforcement members have been developed, opportunities for improvement remain with respect to attachment of the reinforcement members to the facing blocks in the retaining wall systems. As a general proposition, the more efficient the block/grid connection, the fewer the layers of grid that should be required in the wall system. The cost of reinforcing grid can be a significant portion of the cost of the wall system, so highly efficient block/grid connections are desirable.

Many segmental retaining wall systems rely primarily upon frictional forces to hold the reinforcement material between adjacent courses of block. These systems may also include locating pins or integral locator/shear resistance features that enhance the block/grid connection to varying degrees. Examples of such systems include those described in U.S. Pat. Nos. 4,914,876, 5,709,062, and 5,827,015. These systems cannot take advantage of the full tensile strength of the common reinforcement materials, however, because the block/grid holding forces that can be generated in these systems is typically less than the tensile forces that the reinforcing materials themselves can withstand.

One of the many advantages of segmental retaining wall systems over other types of retaining walls is their flexibility. They do not generally require elaborate foundations, and they can perform well in situations where there is differential settling of the earth, or frost heaving, for example, occurs. Even so, these types of conditions might result in differentials in the block/grid connections across the wall in systems that rely primarily on fricitional connection of blocks to grid.

In an effort to improve the grid/block connection efficiency, several current retaining wall systems have been developed that mechanically connect the reinforcement members to the blocks. In several such systems, rake shaped connector bars are positioned transversely in the center of the contact area between adjacent stacked blocks with the prongs of the connector bars extending through elongated apertures provided in the geogrid to retain it in place. Examples of this type of system are shown in U.S. Pat. No. 5,607,262 (FIGS. 1–7), U.S. Pat. Nos. 5,417,523, and 5,540,525. These systems are only effective if the geogrid used is of a construction such that the cross-members that engage the prongs of the connector will resist the tensile forces exerted on the grid by the soil. There are only a few such grids currently available and, thus, the wall builder or contractor has to select geogrid products from a limited number of reinforcement member manufacturers when such an attachment system is used. These systems also rely upon the prongs of the rake connectors being in register with the apertures in the grid material and in contact with the grid cross members. If the connector prongs do not line up with the grid apertures, installation becomes a problem. Variability in the grid manufacturing process means that the apertures in this type of grid frequently are not perfectly regular. A solution to this problem has been to use short connector rakes that only engage several grid apertures, rather than long connectors that engage all of the apertures in a row across the grid layer. This solution eases installation problems, but would appear to make the connection mechanism less efficient, with the consequence that the full strength of the grid cannot be taken advantage of in the design of the wall system. These devices are subject to the same criticisms as the pure friction connector systems.

A third type of connector system uses a channel that, in cross-section, has a relatively large inner portion and a very narrow opening out of that portion. The grid is provided with a bead or equivalent enlargement along its leading edge. The grid is then threaded into the channel from the side, so that the grid layer extends out through the narrow channel opening, but the bead is captured in the larger inner portion. An example of this type of connection is shown in FIGS. 9–10 of U.S. Pat. No. 5,607,262. While this system overcomes differential settling concerns, it is very difficult to use in the field, and relies upon special grid configurations.

A modification of the third type of connector system described above is one in which the channel into which the bead fits is formed by a combination of the lower and adjacent upper block, so that the enlarged/beaded end of the grid can simply be laid in the partial channel of the lower blocks, and will be captured when the upper blocks are laid. This system simplifies installation, but does not resolve the aforementioned performance concerns. In a variation of this system, the end of a panel of geogrid material is wrapped around a bar, which is then placed in a hollowed-out portion of the facing unit which is provided with an integral stop to resist pullout of the bar. Rather than being held in place by the next above facing unit, the wrapped bar is then weighted down with earth or gravel fill dumped on top of it in the hollowed out portion of the facing unit. This system is shown in U.S. Pat. No. 5,066,169. Not only is the facing unit of this system extremely complex and difficult to make, but the installation process is difficult and requires the use of very narrow panels of grid material.

From the above, it can be appreciated that it would be desirable to have a segmental retaining wall system comprising a facing block of a relatively simple shape to facilitate high speed mass production, and wherein the block can be mechanically connected to the reinforcement material in a fashion that is highly efficient, so that a higher percentage of the full design strength of the reinforcement can be taken advantage of, wherein the system can be used with a wide variety of the commonly available geogrids and fabrics, wherein the grid/block connection mechanism is secure even in differential settling conditions, and wherein the system is easy to work with in the field during installation.

SUMMARY OF THE INVENTION

Briefly described, the present invention relates to a wall block for use in a segmental retaining wall system. The wall block comprises an interior face for forming an interior surface of a segmental retaining wall, an exterior face for forming an exterior surface of the segmental retaining wall, first and second sides that extend from the exterior face to the interior face, and a top surface and a bottom surface. Further provided in the wall block is a channel defined by a front wall, a rear wall, and an arcuate bottom surface. The channel extends across one of the faces and surfaces and the rear wall of the channel preferably includes an inwardly extending shoulder.

In one preferred embodiment, the channel is formed transversely in the top surface of the wall block and the front wall of the channel includes an inwardly extending shoulder. Preferably, the rear wall shoulder is defined by an arcuate curve and a planar portion while the front wall shoulder is defined by first and second substantially planar surfaces.

In a further preferred embodiment, the block further comprises a flange that is sized and configured so as to mate with a channel of another of the blocks. Typically, this flange is formed transversely along the bottom surface of the wall block.

The invention may also comprise a layer of reinforcement material (i.e., geogrid or fabric) laid across the top of the block, so that a portion of the reinforcement material lays in the channel formed in the top of the block.

The invention may also comprise a retaining bar adapted to fit into the channel and to engage the layer of reinforcement material in such a manner as to mechanically connect the reinforcement material to the block.

The features and advantages of this invention will become apparent upon reading the following specification, when taken in conjunction with the accompanying drawings.

DETAILED DESCRIPTION

Figure 1:
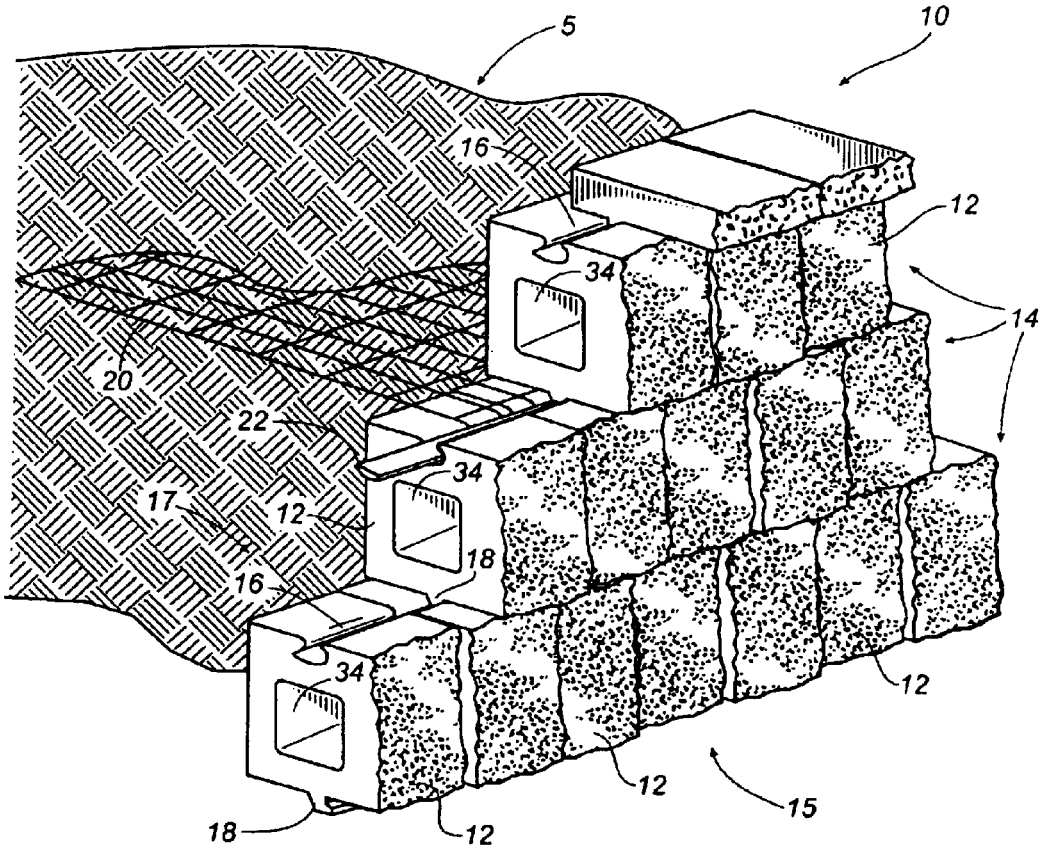
FIG. 1 is a perspective view of an example retaining wall formed in accordance with the present invention.

Referring now in more detail to the drawings, in which like numerals indicate corresponding parts throughout the several views, FIG. 1 illustrates the general concept of a segmental retaining wall 10 constructed in accordance with the present invention. As depicted in this figure, the retaining wall 10 comprises a plurality of wall blocks 12 that are stacked atop each other in ascending courses 14. When stacked in this manner, the wall blocks 12 together form an exterior or decorative surface 15 which faces outwardly away from the soil, and an interior surface 17 which faces inwardly toward the soil.

Figure 2:
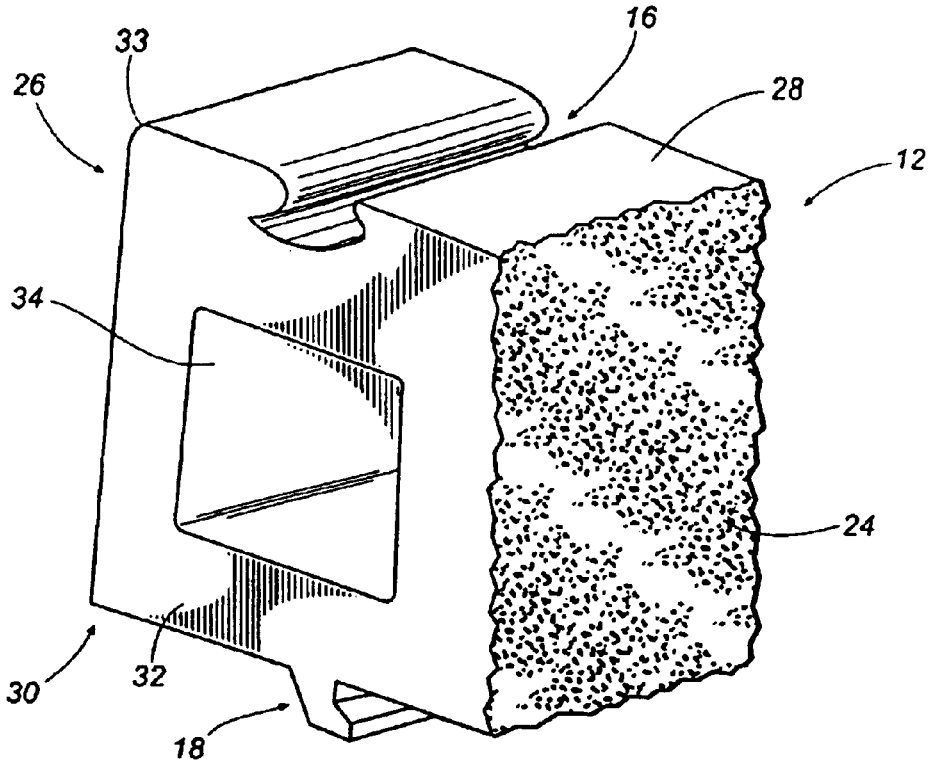
FIG. 2 is a perspective front view of a wall block used in the wall shown in FIG. 1.
Figure 3:
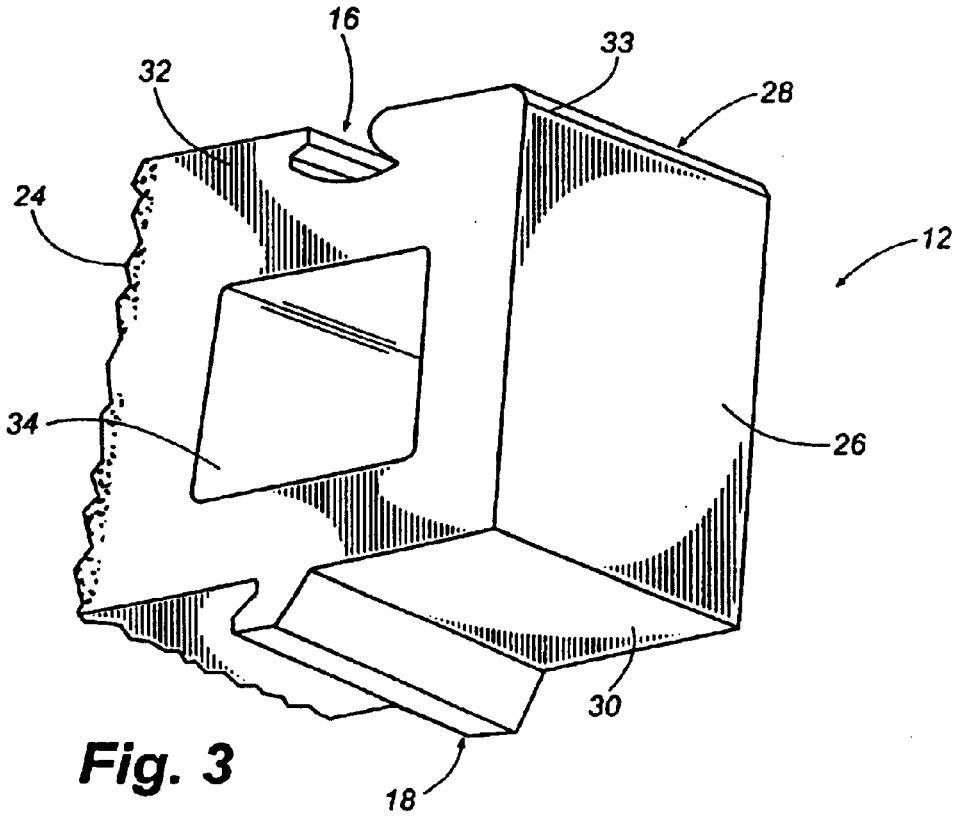
FIG. 3 is a perspective rear view of the wall block shown in FIG. 2.

Generally speaking, the standard wall blocks 12 that comprise the majority of any given wall are substantially identical in size and shape for ease of block fabrication and wall construction. Accordingly, each block 12 typically is configured so as to mate with vertically adjacent blocks 12 when the blocks 12 are stacked atop one another to form the retaining wall 10. Referring to FIGS. 2 and 3, each wall block 12 comprises an exterior face 24, an opposed interior face 26, a top surface 28, a bottom surface 30, and two opposed sides 32. Because the exterior faces 24 of the blocks 12 form the exterior surface 15 of the retaining wall 10, the exterior faces 24 typically are provided with an ornamental texture or facing to create a visually pleasing facade. Also, the exterior face 24 of each wall block 12 is preferably sloped inwardly from the bottom surface 30 to the top surface 28 in an incline ratio of approximately 30 to 1. This inward slope of each block exterior surface 15 creates an aggregate inward slope effect over the entire retaining wall 10 which counteracts the outward leaning impression which can be created by such walls when viewed by the observer. Contrary to the exterior faces 24, the interior faces 26 of the wall blocks 12 preferably are configured in an upright or vertical orientation and, therefore, form an upright, yet stepped (FIG. 8), interior surface 17 of the retaining wall 10.

The top and bottom surfaces 28 and 30 of each block 12 are preferably, but not necessarily, parallel to each other so that, when stacked on top of one another, an upright wall 10 is formed. As shown most clearly in FIGS. 2 and 3, a curved edge 33 is preferably formed at the junction of the top surface 28 and the interior surface 26 to avoid abrasion of reinforcement members that will be secured to the wall formed by the blocks 12. Similar to the top and bottom surfaces 28 and 30, the opposed sides 32 are preferably, but not necessarily, parallel to each other. However, as known in the art, the opposed sides 32 can be inwardly or outwardly tapered from the exterior face 24 of the block 12 to the interior face 26 of the block 12 to form curved walls of nearly any shape. Preferably, the wall blocks 12 further include interior openings 34 which reduce the amount of concrete or other materials needed to fabricate the blocks 12 and reduce the weight of the blocks 12 to simplify wall construction. Although depicted in the figures as being arranged in a horizontal orientation, these openings 34 could be arranged in a vertical orientation, if desired. In either case, the openings 34 are sized so as to maximize the strength of the blocks while still permitting space for connecting tie-back reinforcement members (not shown) to the wall. One tie-back system particularly well-suited for walls constructed with the inventive blocks 12 is that disclosed in U.S. patent application Ser. No. 09/261,420, filed Mar. 3, 1999, which is hereby incorporated by reference into the present disclosure.

As mentioned above, the wall blocks 12 comprise retaining means for attaching reinforcement members (e.g., geogrids) to the retaining wall 10. Preferably, these retaining means include a channel 16 that is formed in each block 12. Preferably, each block 12 has a channel 16 provided in its top surface 28 as shown in FIGS. 2 and 3, although alternative placement is feasible. By way of example, the channel 16 alternatively could be provided in the bottom surface 30 or the interior face 26 of the wall block 12. When provided in the interior face 26 of the block 12, the channel 16 can be arranged either horizontally or vertically therein, although horizontal placement is preferred. When the channel 16 is provided in the top surface 28 as illustrated in FIGS. 2 and 3, however, the channel 16 preferably extends transversely across the block 12 from one side 32 of the block 12 to the other, usually parallel to the interior surface 26 of the block 12. As illustrated most clearly in FIG. 4, the channel 16 is defined by a front wall 36, a rear wall 38, and a bottom surface 40. The front wall 36 preferably includes a shoulder 42 that extends inwardly toward the interior face 26 of the wall block 12. In a preferred embodiment, the shoulder 42 is defined by two substantially planar surfaces 43 and 44. The first planar surface 43 extends inwardly from the top surface 28 of the block at an angle of approximately 90°. The second planar surface 44 extends from the first planar surface 43 at an oblique angle toward the exterior face 24 of the block 12. By way of example, the second planar surface 44 can extend from the first planar surface 43 at an angle of approximately 45°. Preferably, however, the oblique angle will range from approximately 20° to approximately 70°.

Figure 4:
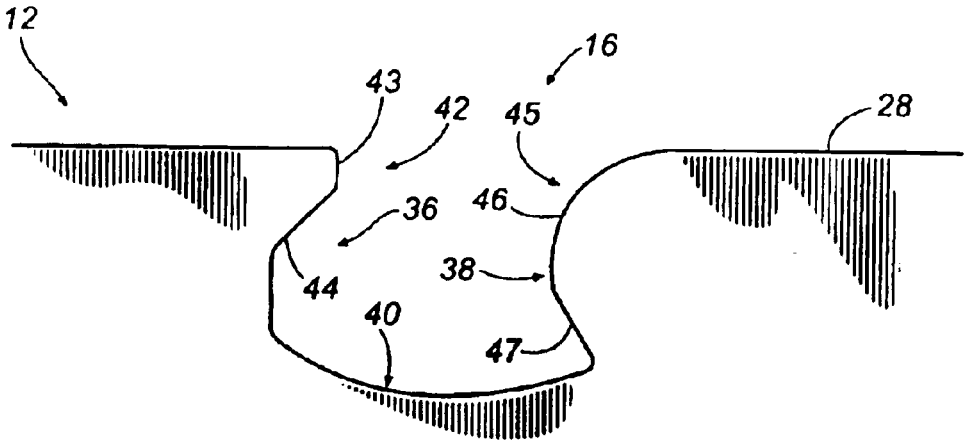
FIG. 4 is a detail view of a channel provided in a top surface of a wall block.
Figure 5:
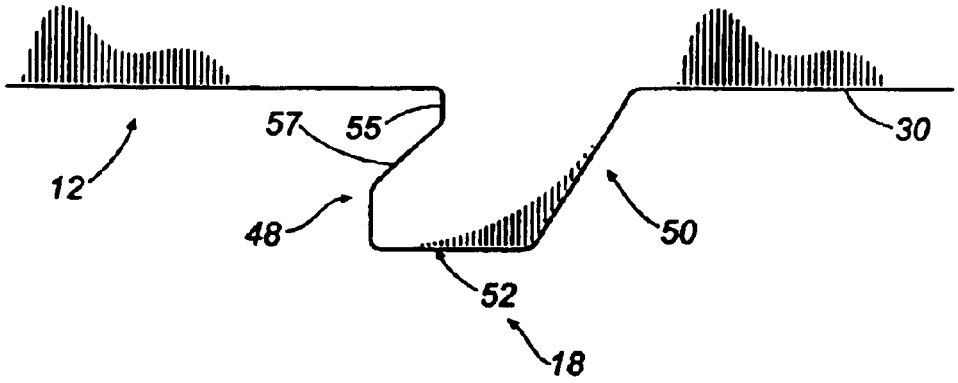
FIG. 5 is a detail view of a flange provided on a bottom surface of a wall block.

Positioned opposite the front wall 36, the rear wall 38 of the channel 16 preferably includes an inwardly extending shoulder 45. However, the rear wall shoulder 45 preferably is arranged as a radiused curve so as to form a substantially arcuate edge 46 and an oblique planar portion 47. As shown in FIG. 4, the bottom surface 40 of the channel 16 can also be formed as a radiused curve. In a preferred embodiment, this curve comprises a radius of curvature of approximately 2 inches. This curvature provides room for the flanges 18 of blocks 12 of upper courses during wall construction and space for a retaining bar (FIG. 7) when a reinforcement member is secured to the wall. Although the channels 16 have been described herein as being arranged in specifically defined configurations, it will be apparent from the present disclosure that these channels 16 could be arranged in alternative configurations. As is discussed hereinafter, an important consideration is that the channel 16 be appropriately situated and configured to work in conjunction with a reinforcement retaining bar 22 (described in more detail hereinafter) to facilitate mechanical clamping of reinforcement members such as geogrids, with limited opportunity for block failure. A further consideration is that the channel 16 can be situated and configured to work in conjunction with a mating flange of a block in an adjacent course to properly locate the courses with respect to each other, to provide resistance to shear forces tending to displace the adjacent courses with respect to each other, and to provide resistance to overturning rotation of the upper block with respect to the adjacent lower block. Depending upon the particular implements used to retain the reinforcement members, the placement of the channel 16, and the degree of course-to-course engagement of blocks desired, the walls 36, 38 of the channel 16 can be formed without shoulders to simplify block construction.

Where a high degree of engagement between blocks in adjacent courses is desired (particularly to prevent the upper block from rotating or overturning during wall construction), as in the preferred embodiment, the front wall shoulder 42 is specifically adapted to receive a flange 18 that extends from substantially each block 12. Most preferably, the flange 18 is provided on the bottom surface 30 of the block 12 and, like the channel 16, extends transversely from one side 32 of the block to the other side 32. As is illustrated in FIG. 5, the flange 18 is defined by a front surface 48, a rear surface 50, and a bottom surface 52. Both the front surface 48 and the rear surface 50 extend obliquely toward the exterior face 24 of the wall block 12 such that the entire flange 18 extends towards the exterior face 24 of the block. When the front wall 36 of the block channels 16 comprise first and second planar surfaces 43 and 44 as described hereinbefore, the front surface 48 of the flange 18 comprises mating first and second planar surfaces 55 and 57. As with the like named surfaces of the channel 16, these first and second planar surfaces 55 and 57 are arranged with the first planar surface 55 extending from the block at an angle of approximately 90° while the second planar surface 57 extends obliquely from the first planar surface 55 at an angle of approximately 45°. To provide for the engagement between vertically adjacent wall blocks 12, the blocks 12 can be placed on top of lower wall blocks 12 such that the flanges 18 extend into the channels 16. Once so situated, the upper wall blocks 12 can be urged forwardly along the lower blocks 12 so that the front surfaces 48 and, in particular, the first planar surfaces 43 and 55 and the second planar surfaces 44 and 57 abut each other. This abutment prevents the blocks 12 from rotating forward or overturning and also provides some resistance to shear forces which may be exerted on the wall structure. In the presently preferred embodiment, the flange measures about 1.30 inches from its juncture with the block body to its bottom surface 52, and is about 1.48 inches thick in the plane of its juncture with the block body. These dimensions give adequate strength to the flange.

The relative front-to-back locations of the flange 18 and channel 16 establish the appropriate location of adjacent courses of block. In the preferred wall structure, the wall has a batter of about 4 degrees. This translates to a course-to-course setback of about 1 inch with blocks of the preferred dimensions. The presently preferred dimensions of the block are about 15 inches from top face to bottom face, about 8 inches from side to side, and about 12 inches from front to back. The preferred weight is about 75 to 85 pounds. As is known in the art, alternative locating means can be used. Examples of alternative locating systems include those of U.S. Pat. Nos. 4,914,876, 5,257,880, 5,607,262, and 5,827,015.

Preferably, the block of the present invention is made from a high strength concrete block mix, which meets or exceeds the ASTM standard for segmental retaining wall blocks, ASTM C1372-97, with the additional requirements that the allowable maximum 24 hour cold water absorption is 7%, and the minimum net area compressive strength is about 3500 psi. It is preferably made in a standard concrete block, paver, or concrete products machine, by a process generally described in, for example, U.S. Pat. No. 5,827,015, which is incorporated herein by reference. The shape of the blocks of the present invention are such that they readily can be made with such equipment. They will preferably be cast on their sides so that the critical channels and flanges are formed by fixed steel mold parts. When cast on their sides, the blocks are of such a configuration as to be easily stripped from the molds.

Figure 6:
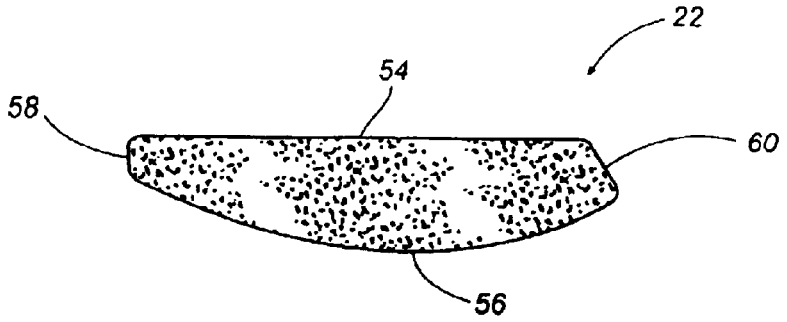
FIG. 6 is an end view of a first embodiment of a reinforcement member retaining bar.

The retaining means of the disclosed system typically further include a reinforcement member retaining bar 22, shown most clearly in FIG. 6. As indicated in this figure, the retaining bar 22 is specifically sized and configured to fit within the channel 16. In a preferred arrangement, the retaining bar 22 has a plurality of different surfaces: a top surface 54, a bottom surface 56, a front surface 58, and a rear surface 60. Preferably, the top surface 54 is substantially planar in shape while the bottom surface 56 is arcuate in shape. In particular, the bottom surface 56 is adapted to follow the contours of the bottom surface 40 of the channel 16. The front surface 58 and the rear surface 60 preferably are planar in shape. Preferably, the front surface 58 extends perpendicularly downward from the top surface 54 so as to mate with the front wall 36 of the channel 16 and the rear surface 60 extends obliquely from the top surface 54 to likewise mate with the rear wall 38. The preferred dimensions of the bar are about 0.6 inch thick at its thickest location, about 0.18 inch at its thinnest location, and about 2 inches from leading edge to trailing edge. Preferably, the bar is 64 inches long, but shorter lengths may be required for tight radius curves.

Figure 10:
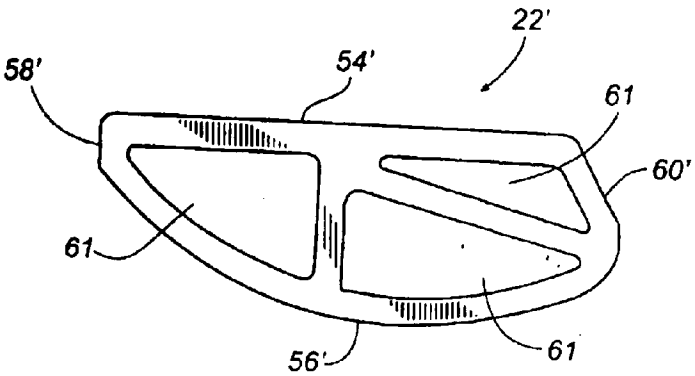
FIG. 10 is an end view of a second embodiment of a reinforcement member retaining bar.

It is presently preferred that the bar has the solid configuration shown in FIG. 6. However, the bar can have a hollow configuration, such as that shown in FIG. 10. As is illustrated in this figure, the retaining bar 22' similarly includes top, bottom, front, and rear surfaces 54'–60', but the interior of the bar 22' includes a plurality of voids 61. Through provision of such voids 61, both the volume of the materials and weight of the bar 22' can be reduced.

Figure 7:
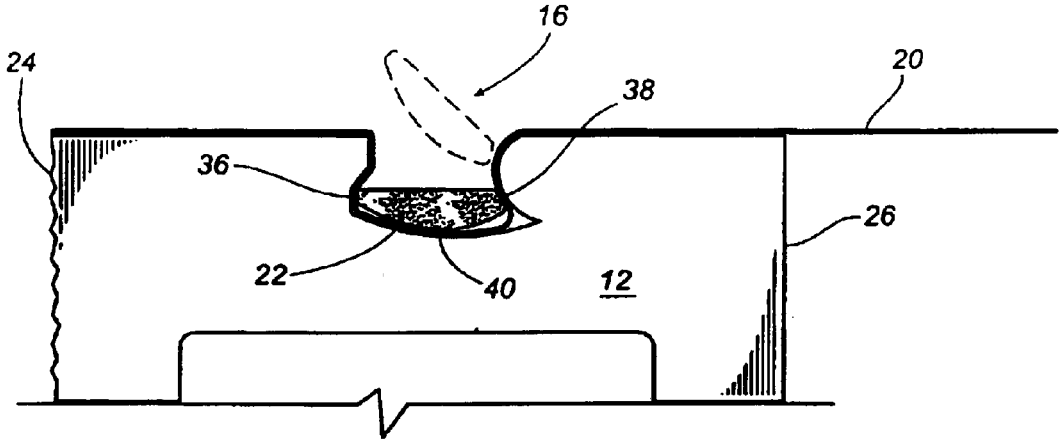
FIG. 7 is a partial side view of a wall block depicting insertion of the retaining bar shown in FIG. 6 over a reinforcement member within a channel of the wall block.

The retaining bar 22, 22' can be constructed of a polymeric or other material. The material needs to be such that its long-term performance in the prevailing environment will be suitable. The presently preferred material for the bar is regrind CPVC, available from Intek Plastics, Inc. We understand this material to comprise about 80% CPVC, about 10% weatherable PVC, and about 10% rigid PVC. Presently, for the preferred bar dimensions, we prefer a material that meets or exceeds the following properties: Young's Modulus=60,000 psi; Engineering Yield Stress=2,048,000 psi; Engineering Strain=$3.41\times10^{-2}$ in/in. Different properties may be appropriate if different dimensions or materials are used for the bar. As shown in FIG. 7, the retaining bar 22 can be positioned on top of a reinforcement member 20 in the channel 16 by inserting the retaining bar 22 into the channel 16 by twisting the bar 22 downwardly into place within the channel 16. The channel 16 needs to be dimensioned to accept the bar 16, the flange 18, and a layer of reinforcement material. In the presently preferred embodiment, a dimension of 0.06 inches is assumed for the thickness of the reinforcement material. This dimension is about that of the thickest geogrids presently known. If the channel is sized to accommodate reinforcement material of this dimension, it can then function with a wide range of reinforcing materials.

Figure 9:
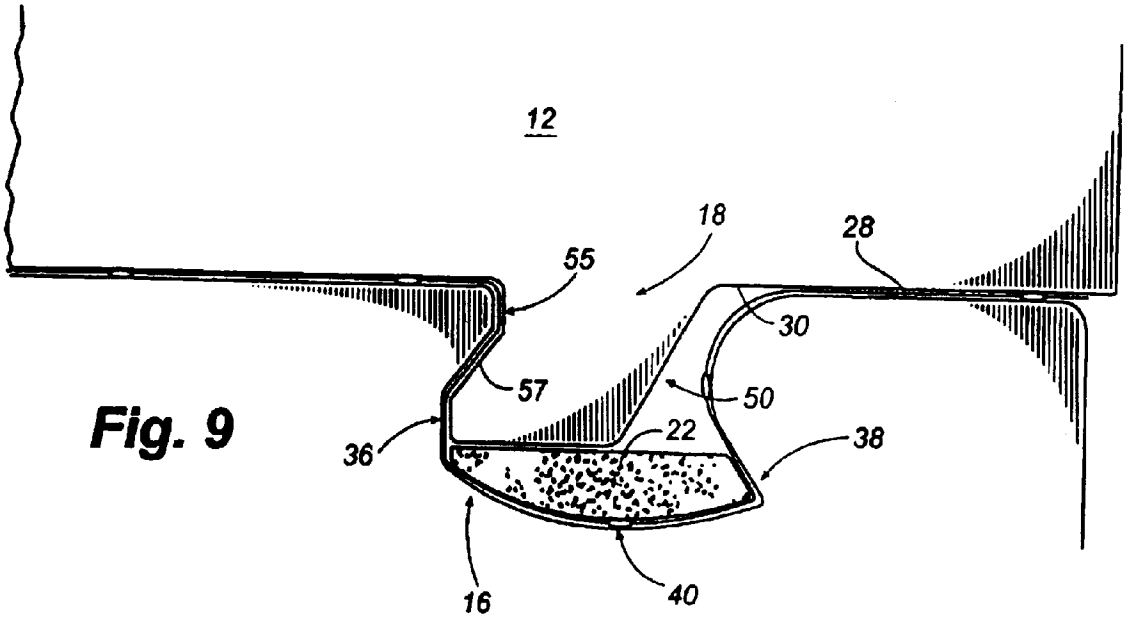
FIG. 9 is a detail view showing the retention of a reinforcement member between adjacent stacked wall blocks.

Once correctly inserted within the channel 16, the retaining bar 22, 22' is securely held within the channel 16 and, in turn, securely holds the reinforcement member 20 in place. The retaining bar 22, 22' bears against the rear wall 38 of the channel and also contacts the bottom surface 52 of the flange 18 of a block situated above (FIG. 9) when a tensile load is applied to the reinforcement member 20. The retaining bar 22, 22' therefore prevents the reinforcement member 20 from being pulled out from the retaining wall 10. More specifically, when a tensile force is applied to the reinforcement member 20 from the soil side of the retaining wall 10, the retaining bar 22, 22' is pulled upwardly in the channel. Contact with the flange inserted into the channel causes the bar to rotate and move further upwardly and backwardly within the channel 16, clamping the reinforcement member 20 between the retaining bar 22 and the rear wall of the channel 16.

This clamping system creates a highly efficient connection between block and grid. In a standard connection test of the type which is well-known to those of skill in the segmental retaining wall art, the following connection strengths were achieved using TC Mirafi 5XT geogrid:

| Normal Load (lb/ft) | Peak Connection (lb/ft) | Service Connection (lb/ft) |
|---|---|---|
| 241 | 3199 | 1509 |
| 798 | 3289 | 1911 |
| 1851 | 3247 | 2222 |
| 2869 | 2731 | 2488 |
| 3860 | 2649 | 2425 |

The long term design strength of the Mirafi 5XT grid, according to the NCMA design methodology is 1084 lbs/ft, so it is apparent that the connection strength generated by the current clamp system is highly efficient.

Testing with TC Mirafi 10XT geogrid (NCMA long term design strength of 2062 lbs/ft) yielded the following results:

| Normal Load (lb/ft) | Peak Connection (lb/ft) | Service Connection (lb/ft) |
|---|---|---|
| 261 | 3536 | 2735 |
| 908 | 4438 | 3016 |
| 1837 | 4548 | 3322 |
| 2910 | 4128 | 3320 |
| 3874 | 4493 | 3634 |

Figure 8:
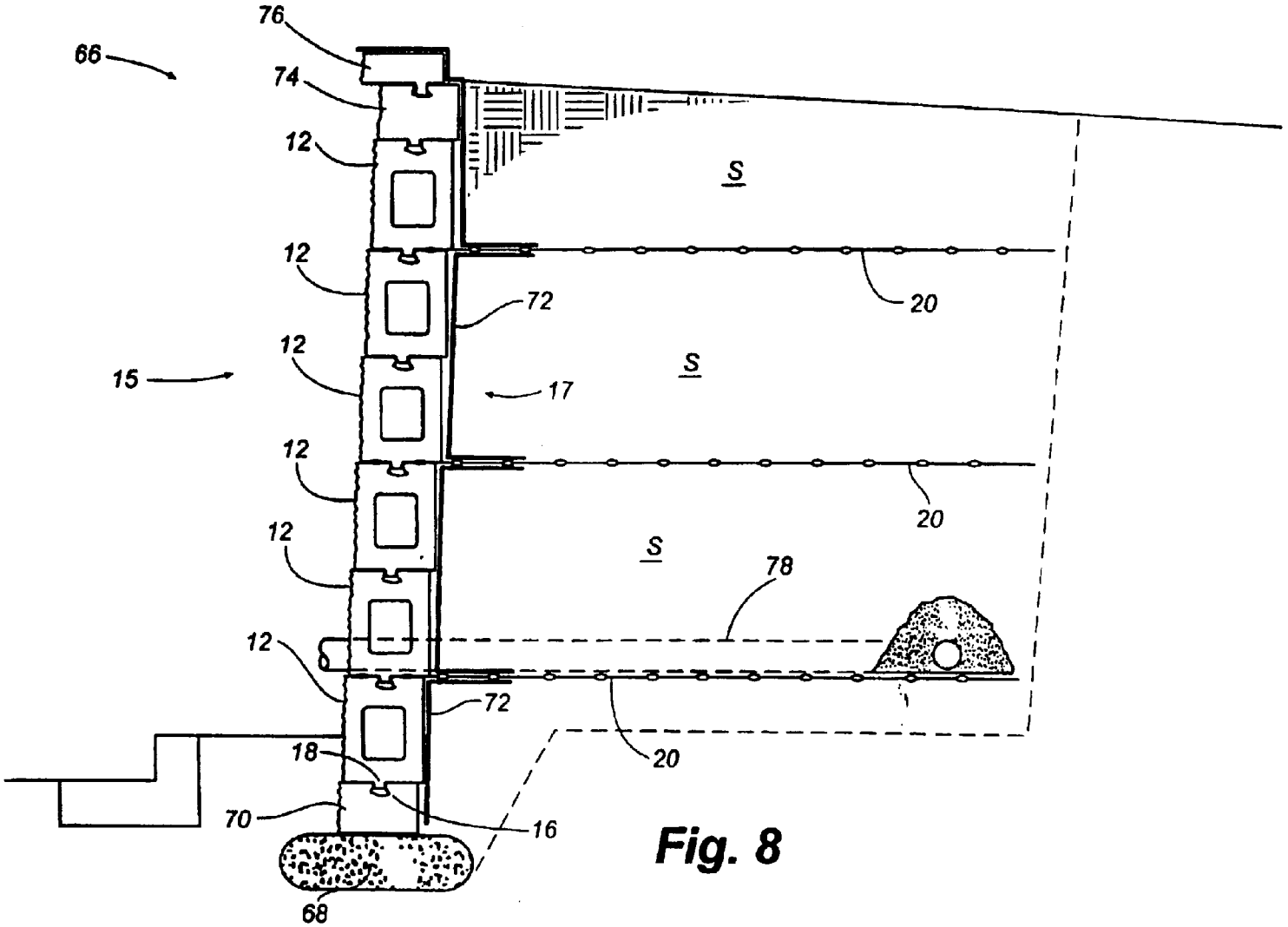
FIG. 8 is a cross-sectional side view of an example retaining wall constructed in accordance with the present invention.

The system of the present invention can be used to construct any number of different configurations of segmental retaining walls. FIG. 8 illustrates another example of such a retaining wall 66. To construct such a wall 66, a leveling pad 68 is normally laid to provide a foundation upon which to build the wall 66. Typically, this leveling pad 68 comprises a layer of compacted, crushed stone that is embedded under the soil to protect the wall foundation. Once the leveling pad 68 is laid and compacted, a plurality of foundation blocks 70 are aligned along the length of the pad 68. Preferably, each of the foundation blocks 70 is solid and provided with a channel 16 in its top surface. Since there are no lower courses with which to engage, the foundation blocks 70 are normally not provided with flanges. Additionally, as depicted in the figure, the foundation blocks 70 can be relatively short in height, for example, approximately half as tall as the standard wall blocks 12 that comprise the majority of the wall 66. Although such foundation blocks 70 typically are used in the first course of the retaining wall 66, it is to be noted that the standard wall blocks 12 could be used to form this course, if desired.

After the first, or foundation, course has been formed with either the foundation blocks 70 or wall blocks 12, the next course of blocks 12 can be laid. The wall blocks 12 are placed on top of the blocks 70 of the foundation course with the flanges 18, if provided, extending into the channels 16 of the lower blocks 70. As can be appreciated from FIG. 8, and with reference to FIGS. 4 and 5, the front surfaces 48 of the flanges 18 mate with the front wall shoulders 42 of the channels 16 such that each flange 18 extends underneath the shoulders 42. This mating relationship holds the wall block 12 in place atop the lower blocks 70 and prevents the wall blocks 12 from tipping forward, thereby providing integral locking means for the blocks 12.

Once the first normal wall course has been formed atop the foundation course, backfill soil, S, can be placed behind the blocks 12. Typically, a non-woven filter fabric 72 is provided between the wall 66 and the backfill soil to prevent the introduction of particulate matter between the courses of blocks 12 due to water migration within the soil. Alternatively, a layer of gravel aggregate can be provided between the wall and the soil to serve the same function. Additional ascending courses thereafter are laid in the manner described above. Although alternative configurations are possible, a reinforcement member 20 typically is laid between every other course of blocks 12 as indicated in FIG. 8. It will be appreciated, however, that greater or fewer reinforcement members 20 can be provided depending upon the particular reinforcement needs of the construction site. Preferably, these reinforcement members 20 are composed of a flexible polymeric materials. As described above, the reinforcement members 20 are positioned so that they extend from the exterior surface 15 of the retaining wall 66, into the channel 16, and past the interior surface 17 of the retaining wall 66 to extend into the soil. As shown most clearly in FIG. 9, a reinforcement member retaining bar 22 is placed on top of the reinforcement member 20 in the channel 16. When the next course of blocks 12 is laid, the flanges 18 of the upper blocks 12 extend into the channels 16 in which the retaining bar 22 is disposed.

Construction of the retaining wall 66 continues in this manner until the desired height is attained. As indicated in FIG. 8, the setback of the wall blocks 12 creates a net inward setback appearance of the retaining wall 66. Additionally, the configuration the blocks 12 creates an aesthetically pleasing stepped appearance for the exterior surface of the wall 66. Where the full height of a wall block 12 is unnecessary or not desired, short wall blocks 74 can be used to form the top or other course. Preferably, these short wall blocks 74 are solid and approximately half the height of the standard wall blocks 12. Once the retaining wall 66 has been raised to the desired height, cap blocks 76 can be used to complete the wall 66. As shown in FIG. 8, these cap blocks 76 can be provided with a flange 18, but do not have an upper channel in that further construction will not be conducted. The cap blocks 76 can be fixed in position with concrete adhesive and provided with an ornamental pattern similar to the exterior faces of the blocks 12, if desired. By way of example, the cap blocks 76 can be designed to extend out over their subjacent blocks 74 to provide an aesthetic lip as illustrated in FIG. 8. Additionally, a subsurface collector drain 78 can be provided within the backfill soil to remove excess water collected therein.

Figure 11:
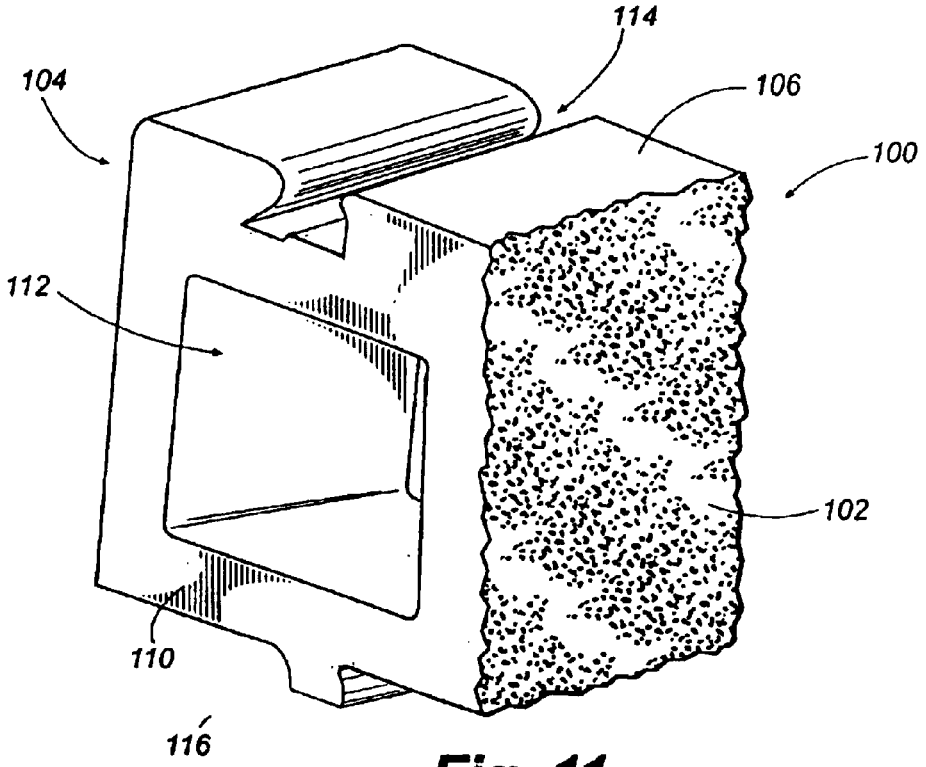
FIG. 11 is a perspective front view of an alternative wall block.
Figure 12:
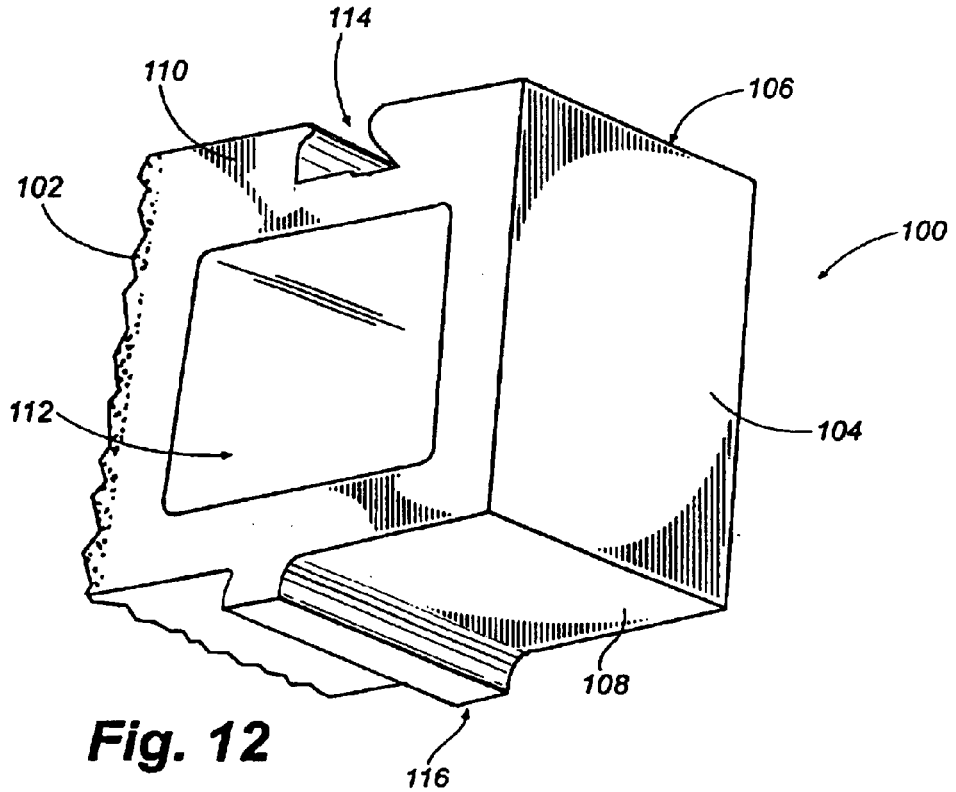
FIG. 12 is a perspective rear view of the wall block shown in FIG. 11.

FIGS. 11–17 depict an alternative wall block 100 constructed in accordance with the present invention. In that the alternative block 100 shares many common features with the preferred wall block 12, the following description of the wall block 100 is focused upon the differences of this block 100. As illustrated in FIGS. 11 and 12, each wall block 100 comprises an exterior face 102, an opposed interior face 104, a top surface 106, a bottom surface 108, and two opposed sides 110. As with the preferred block 12, the exterior faces 102 of the blocks 100 typically are provided with an ornamental texture or facing that is sloped inwardly from the bottom surface 108 to the top surface 106. Also like the preferred block 12, the interior faces 104 of the wall blocks 100 preferably are configured in an upright or vertical orientation. Preferably, the wall blocks 100 further include interior openings 112.

Figure 13:
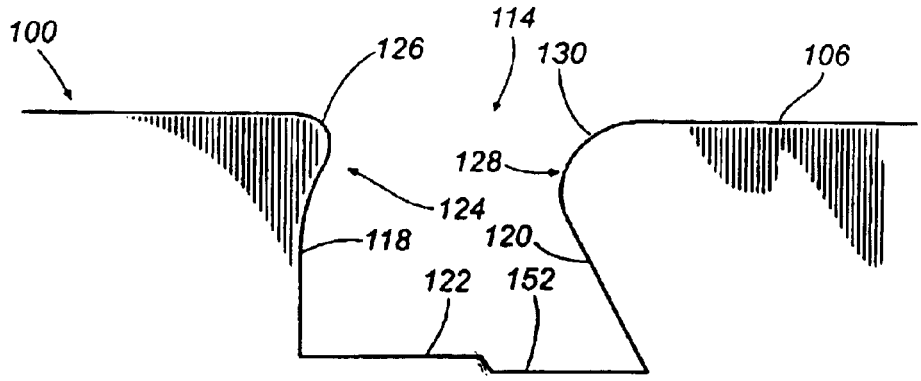
FIG. 13 is a detail view of a channel provided in a top surface of the wall block shown in FIGS. 11 and 12.

As with the preferred blocks 12, the wall blocks 100 each preferably comprises a channel 114. Preferably, once such channel 114 is provided in the top surface 106 of each block 100, although alternative placement is feasible. The channel extends transversely across the block 100 from one side 110 of the block 100 to the other side 110. As illustrated in FIG. 13, the channel 114 is defined by a front wall 118, a rear wall 120, and a channel bottom surface 122. The front wall 118 can include a shoulder 124 that extends inwardly toward the interior face 104 of the wall block 100. As indicated in FIG. 13, the shoulder 124 can be arranged as a curved lip such that the channel 114 comprises a first substantially arcuate edge 126.

Figure 14:
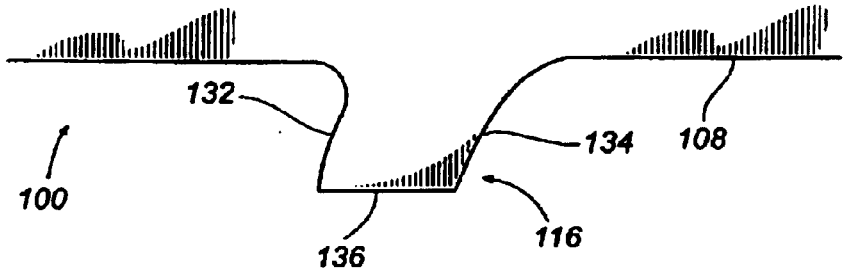
FIG. 14 is a detail view of a flange provided on a bottom surface of a wall block shown in FIGS. 11–13.
Figure 15:
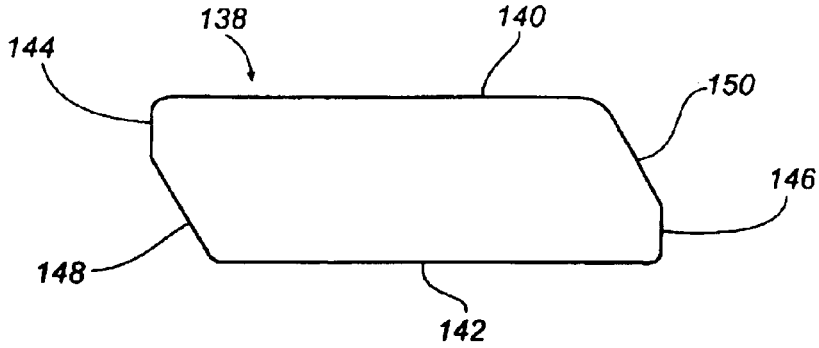
FIG. 15 is a side view of a third embodiment of a reinforcement member retaining bar.

Positioned opposite the front wall 118, the rear wall 120 of the channel 114 also preferably includes an inwardly extending shoulder 128. The rear wall shoulder 128 preferably is arranged as a curved lip so as to form a second substantially arcuate edge 130 of the channel 114. Although the shoulders 124, 128 have been described herein as being arranged as curved lips, it will be apparent from the present disclosure that alternative arrangements are feasible. Indeed, depending upon the particular implements used to retain the reinforcement members, the placement of the channel 114, and the degree of course-to-course locking desired, the walls 118, 120 can be formed without such shoulders 124, 128 to simplify block construction.

Where a high degree of block engagement in adjacent courses is desired, the channel 114 is specifically adapted to receive a flange 116 that extends from the block 100. Preferably, the flange 116 is provided on the bottom surface 108 of the block 100 and extends transversely from one side 110 of the block 100 to the other side 110. As is illustrated in FIG. 14, the flange 116 is defined by a front surface 132, a rear surface 134, and a top surface 136. Both the front surface 132 and the rear surface 134 extend toward the exterior face 102 of the wall block 100. With this configuration, the blocks 100 can be placed on top of lower wall blocks 100 such that the flanges 116 extend into the channels 114. Once so situated, the courses of blocks 100 will resist shear forces in similar manner to courses containing the preferred blocks 12.

When the alternative wall block 100 is used to form a retaining wall, preferably a third embodiment of a reinforcement member retaining bar 138 is used. Shown most clearly in FIG. 15, the retaining bar 138 comprises a plurality of different surfaces: a top surface 140, a bottom surface 142, a first upright surface 144, a second upright surface 146, a first oblique surface 148, and a second oblique surface 150. Preferably, the top surface 140 and the bottom surface 142 are parallel to each other as are the first oblique surface 148 and the second oblique surface 150. Similarly, the first upright surface 144 and the second upright surface 146 preferably are parallel to each other such that the first upright surface 144 extends perpendicularly from the top surface 140 and the second upright surface 146 extends perpendicularly from the bottom surface 142.

Figure 16:
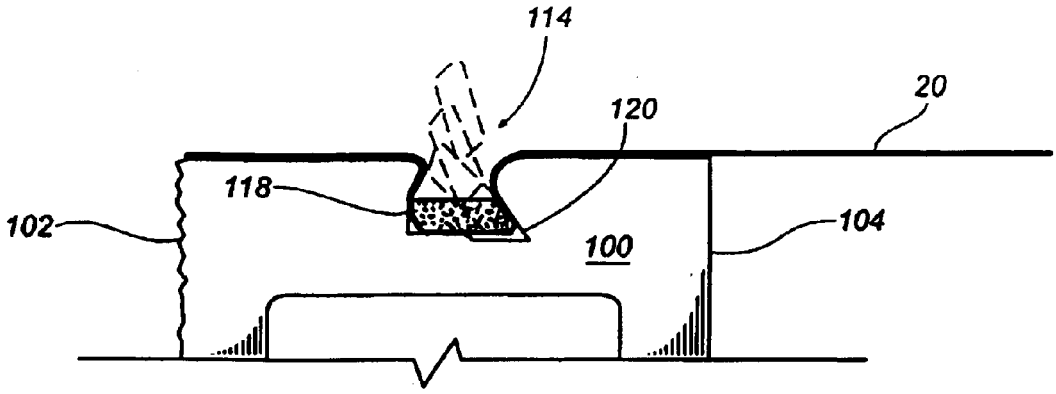
FIG. 16 is a partial side view of a wall block shown in FIGS. 11–14 depicting insertion of the retaining bar shown in FIG. 15 over a reinforcement member within a channel of the wall block.
Figure 17:
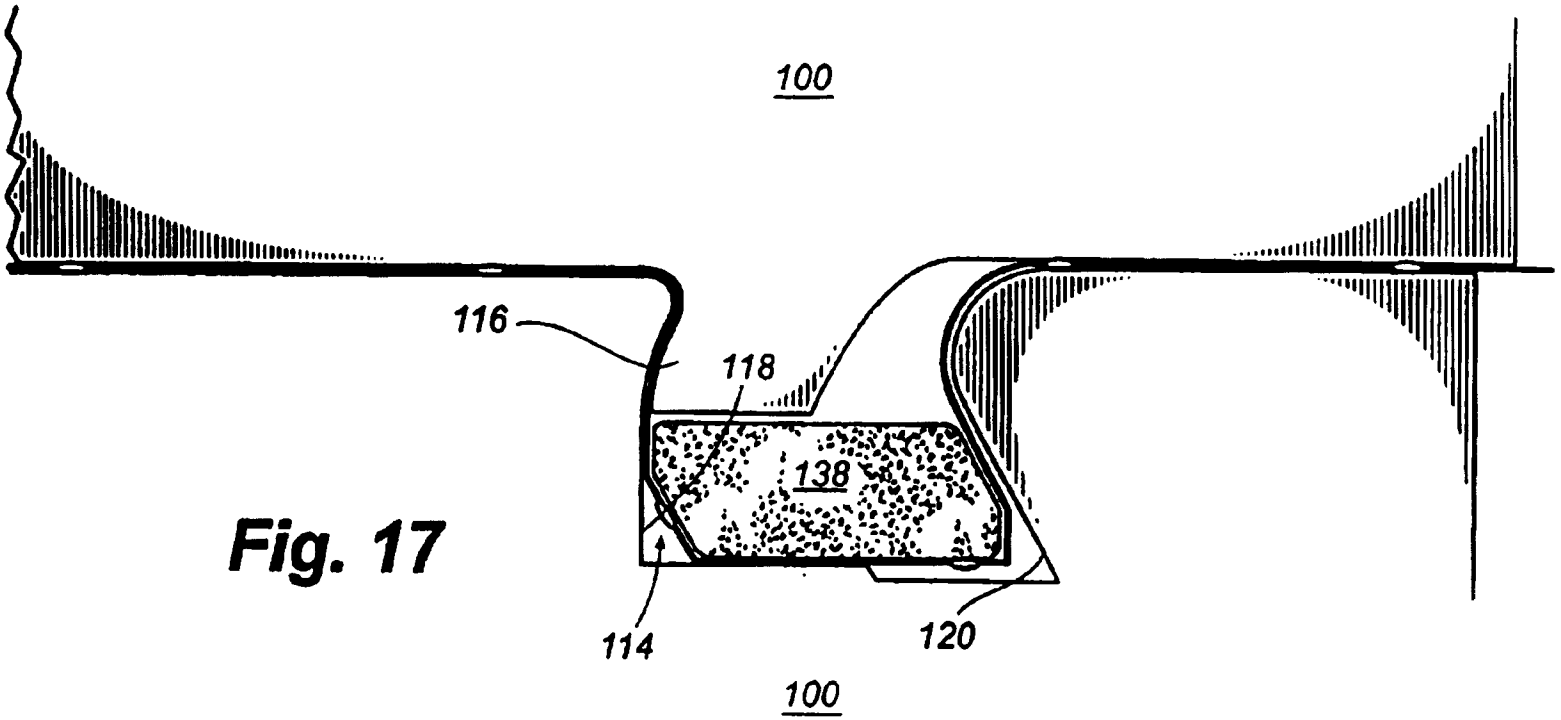
FIG. 17 is a detail view showing the retention of a reinforcement member between adjacent stacked wall blocks.

Configured in this arrangement, the retaining bar 138 can be positioned on top of a reinforcement member 20 in the channels 114 by inserting the retaining bar 138 into the channels 114 in the manner depicted in FIG. 16. In that the bar 138 is designed to fit closely between the front and rear walls 118 and 120 of the channels 114 when in place, a longitudinal notch 152 can be provided in the channel 114 to accommodate the second upright surface 146 during the downward insertion of the bar 138, as illustrated in both FIGS. 16 and 17.

While preferred embodiments of the invention have been disclosed in detail in the foregoing description and drawings, it will be understood by those skilled in the art that variations and modifications thereof can be made without departing from the spirit and scope of the invention as set forth in the following claims. For instance, although particular block configurations have been identified herein, persons having ordinary skill in the art will appreciate that the concepts disclosed herein, in particular the retaining means described herein, are applicable to prior and future wall block designs.

What is claimed is:

1. A segmental retaining wall system, comprising:

a wall block including:

an interior block face for forming an interior surface of a segmental retaining wall, an exterior block face for forming an exterior surface of a segmental retaining wall, first and second block sides that extend from the exterior block face to the interior block face, a block top surface having a lock channel formed therein, the lock channel being defined by a channel front wall, a channel rear wall, and a channel bottom surface, the lock channel extending transversely across the block top surface from the first block side to the second block side, wherein the channel front wall forms a first shoulder that extends towards the interior block face so as to overhang a portion of the channel front wall, wherein the channel rear wall forms a second shoulder that extends towards the exterior block face so as to overhang a portion of the channel rear wall, and wherein the shoulders are spaced apart and run generally parallel to each other along the lock channel, and a block bottom surface;

a soil reinforcement member laid across the block top surface with a portion of the soil reinforcement member laying in front of the lock channel, a portion of the soil reinforcement member laying behind the lock channel, and a portion of the soil reinforcement member inserted in the lock channel; and a retainer bar having front, back, top, and bottom faces, the retainer bar having a front to back dimension that is greater than the closest distance between the first and second shoulders of the lock channel, the retainer bar having a top to bottom dimension that is less than the closest distance between the first and second shoulders of the lock channel;

the lock channel being of such size and shape as to permit the retainer bar to be inserted into the channel through the space between the first and second shoulders, with a portion of the soil reinforcement member interposed between the retainer bar and the channel walls, and then to be rotated into a position below the first and second shoulders in which the retainer bar cannot be removed from the channel, whereby the soil reinforcement member is clamped between the retainer bar and the channel rear wall when a tensile force is exerted on the portion of the soil reinforcement member extending behind the lock channel.

2. The system of claim 1, wherein the back face of the retainer bar is oriented at an angle with respect to the top face of the retainer bar such that, when the retainer bar is rotated into position below the shoulders of the lock channel, the rear face of the retainer bar is substantially parallel to an adjacent portion of the rear channel wall.

3. The system of claim 1, wherein the soil reinforcement member is a synthetic geogrid material.

4. The system of claim 1, wherein the wall block further comprises an interior opening that extends from the first block side to the second block side, whereby, when a plurality of similarly configured blocks are laid side-by-side in a course, the interior openings align to form an internal channel running along the course.

5. The system of claim 1, wherein the channel bottom surface is arcuate.

6. The system of claim 1, wherein the second shoulder is rounded so as to form a substantially arcuate rear edge of the lock channel.

7. The system of claim 1, wherein the exterior block face slopes inwardly from the bottom surface to the top surface of the wall block.

8. The system of claim 1, wherein the wall block is formed of concrete.

9. The system of claim 1, including a lock flange on the bottom surface of the block, the lock flange being defined by a flange front surface extending from the block bottom surface, a flange rear surface extending from the block bottom surface, and a flange bottom surface extending between the flange front and rear surfaces, the lock flange extending transversely across the block bottom surface in substantially the same direction as the lock channel, the lock flange being sized, shaped, and positioned so that the flange will fit into the lock channel of a similarly configured wall block in an adjacent lower course when the lock flange is passed downwardly through the space between the first and second shoulders of the similarly configured wall block into the lock channel of that wall block from above, wherein the flange front surface includes a portion that extends towards the exterior block face so as to overhang a portion of the flange front surface and is sized and shaped so as to engage the first shoulder of the lock channel of the similarly configured block either directly or indirectly if a portion of the soil reinforcement member is interposed between the flange front surface and the first shoulder, such that when the wall block is stacked atop the similarly configured block, the wall block is properly aligned thereon and the engagement between the lock flange and the lock channel of the similarly configured block resists forward leaning or toppling of the wall block.

10. The system of claim 9, wherein the channel front wall comprises a first substantially planar surface that extends approximately perpendicularly downwardly from the block top surface, and a second substantially planar surface that extends obliquely forwardly from the first substantially planar surface.

11. The system of claim 9, wherein the soil reinforcement member is a synthetic geogrid material.

12. The system of claim 9, wherein the wall block further comprises an interior opening that extends from the first block side to the second block side, whereby, when a plurality of similarly configured blocks are laid side-by-side in a course, the interior openings align to form an internal channel running along the course.

13. A segmental retaining wall system, comprising:

a wall block including:

an interior block face for forming an interior surface of a segmental retaining wall, an exterior block face for forming an exterior surface of a segmental retaining wall, first and second block sides that extend from the exterior block face to the interior block face, a block top surface having a lock channel formed therein, the lock channel being defined by a channel front wall, a channel rear wall, and a channel bottom surface, the lock channel extending transversely across the block top surface from the first block side to the second block side, wherein the channel front wall forms a first shoulder that extends towards the interior block face so as to overhang a portion of the channel front wall, wherein the channel rear wall forms a second shoulder that extends towards the exterior block face so as to overhang a portion of the channel rear wall, and wherein the shoulders are spaced apart and run generally parallel to each other along the lock channel, a block bottom surface; and a lock flange on the bottom surface of the block, the lock flange being defined by a flange front surface extending from the block bottom surface, a flange rear surface extending from the block bottom surface, and a flange bottom surface extending between the flange front and rear surfaces, the lock flange extending transversely across the block bottom surface in substantially the same direction as the lock channel, the lock flange being sized, shaped, and positioned so that the flange will fit into the lock channel of a similarly configured wall block in an adjacent lower course when the lock flange is passed downwardly through the space between the first and second shoulders of the similarly configured wall block and into the lock channel of that wall block from above, wherein the flange front surface includes a portion that extends towards the exterior block face so as to overhang a portion of the flange front surface and is sized and shaped so as to engage the first shoulder of the lock channel of the similarly configured block either directly or indirectly if a portion of the soil reinforcement member is interposed between the flange front surface and the first shoulder, such that when the wall block is stacked atop the similarly configured block, the wall block is properly aligned thereon and the engagement between the lock flange and the lock channel of the similarly configured block resists forward leaning or toppling of the wall block.

14. The system of claim 13, wherein the channel front wall comprises a first substantially planar surface that extends approximately perpendicularly downwardly from the block top surface, and a second substantially planar surface that extends obliquely forwardly from the first substantially planar surface.

* * * * *